US005629122A

United States Patent [19]

Tanikawa et al.

[11] Patent Number: 5,629,122

[45] Date of Patent: May 13, 1997

[54] TONER FOR DEVELOPING ELECTROSTATIC IMAGE AND IMAGE FORMING METHOD

[75] Inventors: Hirohide Tanikawa, Yokohama; Shinji Doi, Kawasaki; Masaki Uchiyama, Yokohama, all of Japan

[73] Assignee: Canon Kabushiki Kaisha, Tokyo, Japan

[21] Appl. No.: 465,912

[22] Filed: Jun. 6, 1995

Related U.S. Application Data

[63] Continuation of Ser. No. 110,974, Aug. 24, 1993, abandoned.

[30] Foreign Application Priority Data

Aug. 25, 1992 [JP] Japan ..... 4-247179

[51] Int. Cl.[6] ..... G03G 9/08

[52] U.S. Cl. ..... 430/110; 430/109; 430/904

[58] Field of Search ..... 430/99, 106, 109, 430/110, 124, 904

[56] References Cited

U.S. PATENT DOCUMENTS

| | | | |
|---|---|---|---|
| 2,297,691 | 10/1942 | Carlson | 95/5 |
| 4,578,338 | 3/1986 | Gruber et al. | 430/120 |
| 4,917,982 | 4/1990 | Tomono et al. | 430/99 |
| 4,921,771 | 5/1990 | Tomono et al. | 430/110 |
| 4,988,598 | 1/1991 | Tomono et al. | 430/99 |
| 4,990,424 | 2/1991 | Van Dusen et al. | 430/106.6 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,124,224 | 6/1992 | Berkes et al. | 430/110 |
| 5,135,833 | 8/1992 | Matsunaga et al. | 430/110 |
| 5,212,524 | 5/1993 | Tanikawa et al. | 355/251 |

FOREIGN PATENT DOCUMENTS

| | | |
|---|---|---|
| 0531990 | 3/1993 | European Pat. Off. . |
| 42-23910 | 11/1967 | Japan . |
| 43-24748 | 10/1968 | Japan . |
| 52-3304 | 1/1977 | Japan . |
| 52-3305 | 1/1977 | Japan . |
| 57-52574 | 11/1982 | Japan . |
| 025642 | 2/1983 | Japan . |
| 60-217366 | 10/1985 | Japan . |
| 60-252360 | 12/1985 | Japan . |
| 60-252361 | 12/1985 | Japan . |
| 61-138259 | 5/1986 | Japan . |
| 61-94062 | 5/1986 | Japan . |
| 155459 | 7/1986 | Japan . |
| 61-273554 | 12/1986 | Japan . |
| 62-14166 | 1/1987 | Japan . |
| 63-149669 | 6/1988 | Japan . |
| 1-109359 | 4/1989 | Japan . |
| 2-79860 | 3/1990 | Japan . |
| 2-123385 | 5/1990 | Japan . |
| 3-50559 | 3/1991 | Japan . |
| 4-89868 | 3/1992 | Japan . |
| 4-145103 | 5/1992 | Japan . |

OTHER PUBLICATIONS

Database WPI, Week 8837, Derwent Public. AN 88-261827 (37).

Patent Abstracts of Japan, vol. 9, No. 50 (P-339) Mar. 1985.

*Primary Examiner*—Hoa Van Le

*Attorney, Agent, or Firm*—Fitzpatrick, Cella, Harper & Scinto

[57] ABSTRACT

Disclosed is a toner for developing an electrostatic image. The toner comprises a binder resin and a wax, and the value of weight average molecular weight/number average molecular weight (Mw/Mn) of the wax is not more than 1.5.

18 Claims, 1 Drawing Sheet

TONER FOR DEVELOPING ELECTROSTATIC IMAGE AND IMAGE FORMING METHOD

This application is a continuation of application Ser. No. 08/110,974 filed Aug. 24, 1993, now abandoned.

BACKGROUND OF THE INVENTION

1. Field of the Invention

This invention relates to a toner for developing an electrostatic image, used in electrophotography, electrostatic recording and magnetic recording.

2. Related Background Art

A number of methods have been known for electrophotography as disclosed in U.S. Pat. No. 2,297,691, Japanese Patent Publications No. 42-23910 and No. 43-24748 and so forth. In general, copies are obtained by forming an electrostatic latent image on a photosensitive member by utilizing a photoconductive material and by various means, subsequently developing the latent image with a toner, and transferring the toner image to a recording medium such as paper if necessary, followed by fixing with heat, pressure, heat-and-pressure, or solvent vapor. The toner not transferred and remaining on the photosensitive member is cleaned by various means, end then the above process is repeated.

In recent years, such copying apparatuses have been used not only as office copying machines to merely wake, copies of originals but have also been used printers for output means of computers or in the field of personal use.

Under such circumstances, the down sizing and weight reduction of the apparatus are eagerly sought as well as the higher-speed and higher reliability. Thus, the constitution elements of the machines now become simpler in various points. As a result, higher performance is required for the toner, and it is now impossible to improve machines without accomplishing the improvement of the toner performance.

It is known to incorporate wax in the toner as a fixing auxiliary component. For example, such techniques are disclosed in Japanese Patent Applications Laid-open No. 52-3304, No. 52-3305 and No. 57-52574.

Techniques for incorporating waxes are also disclosed in Japanese Patent Applications Laid-open No. 3-50559, No. 2-79860, No. 1-109359, No. 62-14166. No. 61-273554, No. 61-94062, No. 61-138259, No. 60-252361, No. 60-252360 and No. 60-217366.

Waxes are used to improve anti-offset properties of toners in low- and high-temperature fixing or to improve fixing performance in low-temperature fixing.

It is difficult, however, to satisfy both low-temperature fixability and anti-blocking property. In printers or copying machines using electrophotographic techniques, corona dischargers have been commonly used as a means for uniformly charging the surface of a photosensitive member (an electrostatic image bearing member) or as a means for transferring a toner image to the surface of the photosensitive member. However, a direct charging and transfer method has been developed in which voltage is externally applied to the charging means while the charging member is in contact with, or pressed against, the surface of the photosensitive member directly or through a recording medium. This method is now in practical use.

Such a method is disclosed, for example, in Japanese Patent Applications Laid-open No. 63-149669 and No. 2-123385. These are concerned with contact charging or contact transfer, where a conductive elastic roller is brought into contact with an electrostatic image bearing member to uniformly charge the electrostatic image bearing member by applying a voltage to the conductive roller, the image bearing member is then subjected to exposure and development to obtain a toner image, and thereafter, another conductive elastic roller to which a voltage has been applied is pressed against the electrostatic image bearing member interposing a transfer medium between them to transfer the toner image formed on the electrostatic image bearing member to the transfer medium, followed by fixing to obtain a copied image.

In such a process, the toner is pressed to the photosensitive member by the charging members, and hence the toner tends to melt-adhere to the photosensitive member. This tendency increases when a wax is used to improve fixing performance.

SUMMARY OF THE INVENTION

An object of the present invention is to provide a toner for developing an electrostatic image, having solved the problems as discussed above, and an image forming method making use of such a toner.

Another object of the present invention is to provide a toner for developing an electrostatic image, having superior fixing performance and anti-offset properties in low-temperature fixing, and an image forming method making use of such a toner.

Still another object of the present invention is to provide a toner for developing an electrostatic image, having a superior blocking resistance, and an image forming method making use of such a toner.

Further object of the present invention is to provide a toner for developing an electrostatic image, that may cause no melt-adhesion to the electrostatic image bearing member and having a superior running performance, and an image forming method making use of such a toner.

To achieve the above objects, the present invention provides a toner for developing an electrostatic image, comprising a binder resin and a wax, said wax having a value of weight average molecular weight/number average molecular weight (Mw/Mn) of not more than 1.5.

The present invention also provides an image forming method comprising;

- bringing a contact charging means into contact with an electrostatic latent image bearing member to electrostaticaly charge the electrostatic latent image bearing member;
- forming an electrostatic latent image on the charged electrostatic latent image bearing member;
- developing the electrostatic latent image by the use of a toner to form a toner image; said toner comprising a binder resin and a wax, said wax having a value of weight average molecular weight/number average molecular weight (Mw/Mn) of not more than 1.5;
- bringing a contact transfer means into contact with the electrostatic latent image bearing member interposing a recording medium between them to transfer the toner image to the recording medium; and
- fixing the toner image to the recording medium by a heat-fixing means.

DESCRIPTION OF THE PREFERRED EMBODIMENTS

Figure 1:
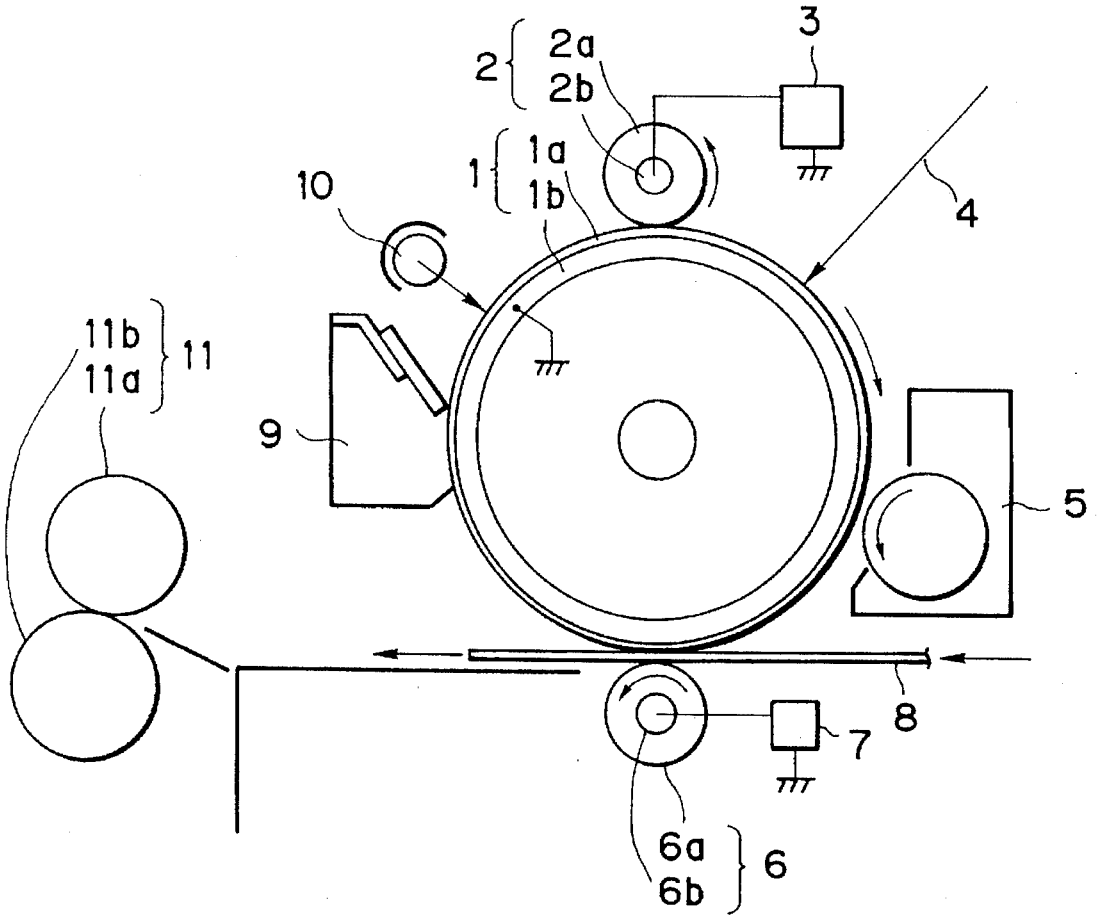
FIG. 1 is a schematic illustration used to describe the image forming method making use of a contact charging means and a contact transfer means according to the present invention.

Waxes have been used as a component for improving anti-offset properties. They on the other hand may often reduce blocking resistance or cause melt-adhesion of toner. Wax is an aggregate of molecules having a molecular weight distribution, and the properties greatly depend on the molecular weight. In general, waxes are effective for high-temperature anti-offset properties. They can be also effective for low-temperature anti-offset properties and low-temperature fixing by increasing low-molecular weight components.

When the low-molecular weight components are increased to improve the performances, the components of much lower molecular weights are included, so that the toner tends to undergo a thermal change and hence tends to have a poor blocking resistance or cause melt-adhesion of toner. Thus, when a conventional wax is employed so as to include more low-molecular weight component in order to improve the low-temperature fixing performance or low-temperature anti-offset properties, the components of much lower molecular weight increase to bring about a lowering of blocking resistance and an increase in melt-adhesion.

Accordingly, by making the molecular weight distribution of the wax sharp so that only preferable molecular weight components can be used, it is possible to improve low-temperature fixing performance and improve anti-offset properties without reducing the blocking resistance and melt-adhesion resistance.

For this reason, the wax used in the present invention has a value of weight average molecular weight/number average molecular weight (Mw/Mn) of not more than 1.5, and preferably not more than 1.45, in molecular weight distribution measured by GPC (gel permeation chromatography). This can solve the problems previously discussed.

Use of a wax having Mw/Mn of more than 1.5 may cause the problem that any of development property, melt adhesion resistance in the image forming apparatus, anti-blocking property may become insufficient.

The wax used in the present invention should preferably have a number average molecular weight (Mn) of from 300 to 1,500, more preferably from 400 to 1,200, and still more preferably from 600 to 1,000, and should preferably have a weight average molecular weight (Mw) of from 500 to 2,250, more preferably from 600 to 2,000 and still more preferably from 800 to 1,800.

When a wax has a number average molecular weight (Mn) of less than 300 or a weight average molecular weight (Mw) of less than 500, the low-molecular weight components become excess, thus the blocking resistance and developability tend to lower, or melt-adhesion of toner will occur in image forming apparatus with the factors such as lapse of time, storage, running and temperature rise. A wax having a number average molecular weight (Mn) of more than 1,500 or a weight average molecular weight (Mw) of more than 2,250 tends to bring about a lowering of low-temperature anti-offset properties and low-temperature fixing performance.

In the present invention, the molecular weight distribution of the wax is measured by gel permeation chromatography (GPC) under the following conditions.

GPC measurement conditions

Apparatus: GPC-150 (Waters Inc.)

Columns: GMH-HT 30 cm, dual columns (available from Toso Co., Ltd.)

Temperature: 135° C.

Solvent: o-Dichlorobenzene (0.1% ionol-added)

Flow rate: 1.0 ml/min

Sample: 0.4 ml of 0.15% sample is injected.

Measured under conditions described above, molecular weight of the sample is calculated using a molecular weight calibration curve prepared using a monodisperse polystyrene standard sample, and by converting the value in terms of polyethylene according to a conversion formula derived from the Mark-Houwink viscosity formula.

The wax having a sharp molecular weight distribution so as to have Mw/Mn of not more than 1.5, can be obtained by using press sweating method, solvent method, recrystallization method, vacuum distillation method, supercritical fluid extraction method, or melt-crystallization method, to fractionate the wax according to the molecular weight. Among these methods, preferable are the supercritical fluid extraction method in which the solvent is in a gaseous form and can be readily removed and recovered, and which can provide fractions of desired molecular weight, end the vacuum distillation combined with melt-crystallization of the distillate followed by filtration of crystals.

These methods can provide a wax from which the lower-molecular weight components have been removed or a wax from which the lower-molecular weight components have been extracted, or any of these from which the lower-molecular weight components have been further removed, so that a wax having a sharp molecular weight distribution only in any desired molecular weight region can be obtained.

As disclosed in Japanese Patent Application Laid-Open No. 4-89868, the supercritical fluid extraction method is a method in which wax material is extracted and dissolved into $CO_2$ of supercritical state, and the extracted wax is precipitated from the $CO_2$ by reducing the pressure of $CO_2$ containing the wax.

For example, wax is put into a pressure-proof extraction vessel and extracted and dissolved into $CO_2$ of supercritical state at 130° C. and 300 atmosphere, then the pressure of $CO_2$ is reduced to 250 atm, and the dissolved wax is transfered to a pressure-proof separation vessel, where the wax of high melting poiont is precipitated. Further, with pressure reduction to 200 atm, the $CO_2$ still containing unseparated wax is transferred to another separation vessel, where the next part of wax of high melting point is separated. Repeating this process, the wax components are fractionated according to their molecular weight.

The extraction-solubility of wax depends on the pressure and the temperature of $CO_2$, especially to the pressure change, and the dependency greatly varies according to the molecular weight of the wax. Therefore, as the number of separation operation (times of pressure reduction) is increased, or the difference between each pressure is made smaller, the molecular weight distribution of the separated wax becomes narrower.

Conditions for the first extraction can be chosen to dissolve all wax components or it may be a lower pressure condition to permit some wax components of high melting point to remain undissolved. Wax components can be fractionated by gradually reducing the pressure of wax-containing gas, or it is possible to extract wax components separately by changing the extraction conditions in the extraction vessel. $CO_2$ is preferred as the extraction gas, but ethane, ethylene, propane etc. can be used. Further, some organic solvents such as toluene can be added to the extraction gas. The extraction temperature can be between room temperature and 300° C., preferably from 100° to 200° C. considering the extraction efficiency. The pressure of extraction should be the pressure at which the gas becomes supercritical fluid, for $CO_2$, it may be 75–300 atm depending to the extraction temperature. The pressure at separation can be properly selected to become lower than that of extraction.

The vacuum distillation method, or that combined with the melt-crystallization of the distillate and the crystal filtration are as follows. As disclosed in Japanese Patent Application Laid-Open No. 4-145103, the components of lower molecular weight are collected by distillation and the distillate is molten, and the temperature of the melt is lowered to precipitate the crystals in part and the crystals are collected by filtration. Repeating the melt-crystallization process, the fractionated wax is obtained as crystals. The step of distillation is preferably carried out plural times, that is, by the first distillation the fraction of the lowest molecular weight is obtained and remaining liquid is subjected to the distillation at higher temperature or under more reduced pressure to obtain a fraction of higher molecular weight. By repeating such a process, fractions having successively higher molecular weight can be obtained as distillates. From these fractions subjected to melt-crystallization-filtration, waxes of narrower molecular weight distribution can be obtained compared with those obtained from one distillation operation. As mentioned above, plural distillation of the low material wax is preferable to obtain fractionated wax having narrow molecular weight distribution.

The distillation operation can be carried out with the conventional apparatus and method. For example, the disillation of the first step is carried out at 5–8 mmHg and 260°–290° C. the second step at 0.1–0.01 mmHg and 250°–270° C., the third step at 0.01 mmHg and 290° C., and the fourth step at 0.001 mmHg and 290° C. It is preferable to use thin membrane distillation equipment for the second to the fourth distillation for distillation efficiency. The conditions can be changed according to the wax to be obtained.

Then the distillate is heated at the certain temperature to melt. By cooling the melt, crystals are partly precipitated and filtrated from the melt through a filter. The first step crystals obtained by filtration is of higher molecular weight, that is, of higher melting point. The crystals thus separated are a wax fraction having a narrow molecular weight distribution. The melt passed through the filter is further cooled to precipitate the second step crystals having lower molecular weight or lower melting point, which are separated by filtration. Subsequently, the remaining melt is further cooled to obtain the third step crystals through crystallization and filtration as mentioned above. By repeating such a melt-crystallization-filtration process, plural wax fractions having serial molecular weights and melting points, from high molecular weight and high melting point to low molecular weight and low melting point are obtained. The crystallization from the melt can be carried out by continuously lowering the temperature and collect the crystals in a given temperature range. The precipitation rate depends on the number of melt-crystallization, molecular weight distribution and the melting point of the fractionated wax. When a distillate should be equally divided by one crystallization, the yield of crystals is set to 50%. In general, to obtain the wax fractions having a narrower molecular weight distribution, it is preferable that the crystal yield is not more than 70%, more preferably not more than 50%. For crystallization of a melt, ordinary method can be applied. For example, the starting wax is heated to melt in a vessel, and then cooled to a certain temperature for partial crystallization. At this time, the wax is not necessarily completely melted but partly melted. The cooling speeds not defined but slow cooling is preferable. On crystal precipitation, an auxiliary can be added, selected from inorganics such as talc, metal salts of higher fatty acids and polymers such as polyethylene of which melting point is higher than that of the starting wax. Agitation may be carried out. The filtration of the precipitated crystals from the melt is also carried out by the conventional filter filtration. Pressure application such as suction and pressing can accelerate the filtration.

For the wax used in the present invention, it is preferred that, in the DSC curve of the wax measured using a differential scanning calorimeter, the onset temperature of an endothermic peak is 50° C. or above, particularly preferably within the range of from 50° C. to 120° C., end more preferably from 50° C. to 110° C., during temperature rise. It is also preferred that the peak top temperature of the maximum endothermic peak is 130° C. or below, end particularly preferably within the range of from 70° to 130° C. During temperature rise, changes in condition of the wax with heat application can be observed where the endothermic peaks are ascribable to transition, melting and dissolution of the wax. The wax can satisfy the developability, blocking resistance and low-temperature fixing performance when the onset temperature of the peak is preferably within the range of from 50° C. to 120° C. If this onset temperature of the peak is lower than 50° C., the transition temperature of the wax is so low that the toner tends to have poor blocking resistance or poor developability at the high temperature. If it is higher than 120° C., the transition temperature of the wax is so high that satisfactory fixing performance is diffilult to obtain. Particularly good fixing performance and anti-offset properties can be obtained when the maximum endothermic peak is present in the area not higher than 130° C., preferably within the range of from 70° to 130° C., and particularly preferably within the range of from 85° to 120° C. If the peak temperature of the maximum peak is lower than 70° C., the melting temperature of the wax is so low that it is hard to achieve satisfactory high-temperature anti-offset properties. If the peak temperature of the maximum peak is higher than 130° C., the melting temperature of the wax is so high that it is difficult to achieve satisfactory low-temperature anti-offset properties and low-temperature fixing performance. Namely, if the peak temperature of the maximum peak is within this range, it is easy to balance the anti-offset properties and the fixing performance.

To improve the high-temperature anti-offset properties, it is also preferred that the end point onset temperature of the endothermic peak is 80° C. or above, more preferably from 80° to 140° C., still more preferably from 90° to 130° C., and particularly preferably from 100° to 130° C.

Also, a difference between the end point onset temperature and the onset temperature should be from 70° to 5° C., preferably from 60° to 10° C., and more preferably from 50° to 10° C.

Controlling the stated temperatures as described above makes it easy to balance the low-temperature fixing performance, anti-offset properties, blocking resistance and developability. For example, if the temperature ranges exceed the stated ranges, the blocking resistance may become poor even if the low-temperature fixing performance and anti-offset properties can be achieved.

In the present invention, the DSC measurement is carried out to measure the heat exchange of the wax to observe its behavior. Hence, in view of the principle of measurement, the measurement may preferably be carried out using a highly precise differential scanning calorimeter of inner heat input compensation type. For example, it is possible to use SDC-7, manufactured by Perkin Elmer Co.

The measurement is carried out according to ASTM D3418-82. The DSC curve used in the present invention is a DSC curve measured while the temperature is raised at a rate of 10° C./min after temperature was once raised and dropped to take a history. Each temperature is defined as follows:

Onset temperature of endothermic peak:

The temperature where a tangent line drawn on the first maximum differential point of the DSC curve intersects the base line in the temperature rise.

Peak top temperature of maximum peak:

A peak top temperature of the highest peak from the base line.

End point onset temperature of endothermic peak:

The temperature where the tangent line drawn on the last minimum differential point of the DSC curve in the temperature rise intersects the base line.

The wax used in the present invention is obtained from the following waxes: They include a paraffin wax and derivatives thereof, a montan wax and derivatives thereof, a microcrystalline wax and derivatives thereof, a Fischer-Tropsch wax and derivatives thereof, and a polyolefin wax and derivatives thereof. The derivatives include oxides, block copolymers with vinyl monomers, and graft-modified products.

As other waxes, it is also possible to use alcohols, fatty acids, acid amides, esters, ketones, hardened castor oil and derivatives thereof, vegetable waxes, animal waxes, mineral waxes and petrolactams. The derivatives include saponified products, salts, alkylene oxide adducts and esters.

In particular, waxes preferably usable are those obtained from the following: Low-molecular weight polyolefins obtained by subjecting olefins to radical polymerization under a high pressure or polymerization in the presence of a Ziegler catalyst, and by-products from such polymerization; low-molecular weight polyolefins obtained by thermal decomposition of high-molecular weight polyolefins; and distillate residues of hydrocarbons obtained from a synthesis gas consisting of carbon monoxide and hydrogen, in the presence of a catalyst, or hydrogenized synthetic hydrocarbons thereof. Antioxidants may be added to the resulting waxes. Straight-chain alcohols, alcohol derivatives, fatty acids, acid amides, esters or montan derivatives are also preferred. Fatty acids from which impurities have been removed are still also preferred.

Particularly preferred waxes are those mainly composed of hydrocarbons having thousands of carbon atoms, in particular, up to about 1,000 carbon atoms, those obtained by polymerizing olefins such as ethylene in the presence of a Ziegler catalyst, and by-products from the polymerization; and Fischer-Tropsch wax.

It is also possible to use those obtained by subjecting fractionated waxes to oxidization, block polymerization or graft modification after waxes have been fractionated by the methods described above.

As other properties, the wax may preferably have a penetration of 10.0 or less, and particularly preferably 5.0 or less, at 25° C. It may also preferably have a melt viscosity of 200 cP or less at 140° C. The penetration is a value measured according to JIS K-2207. The melt viscosity is a value measured using a Brookfield viscometer.

In the toner of the present invention, any of these waxes may be used in a content of 20 parts by weight based on 100 parts by weight of binder resin. It is effective to use the wax in a content of from 0.5 to 10 parts by weight. The wax may also be used in combination with other waxes.

As the binder resin used in the toner of the present invention, the following binder resins can be used.

For example, usable ones are homopolymers of styrene or derivatives thereof such as polystyrene poly-p-chlorostyrene and polyvinyltoluene; styrene copolymers such as a styrene/p-chlorostyrene copolymer, a styrene/vinyltoluene copolymer, a styrene/vinylnaphthalene copolymer, a styrene/acrylate copolymer, a styrene/methacrylate copolymer, a styrene/methyl α-chloromethacrylate copolymer, a styrene/acrylonitrile copolymer, a styrene/methyl vinyl ether copolymer, a styrene/ethyl vinyl ether copolymer, a styrene/methyl vinyl ketone copolymer, a styrene/butadiene copolymer, a styrene/isoprene copolymer and a styrene/acrylonitrile/indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. Preferable binder materials may include styrene copolymers or polyester resins.

Comonomers copolymerizable with styrene monomers in styrene copolymers may include vinyl monomers such as monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether; any of which may be used alone or in combination of two or more.

The styrene polymers or styrene copolymers may be cross-linked, or may be in the form of mixed resins.

As a cross-linking agent, compounds having at least two polymerizable double bonds may be used. It may include aromatic divinyl compounds as exemplified by divinyl benzene and divinyl naphthalene; carboxylic acid esters having two double bonds as exemplified by ethylene glycol diacrylate, ethylene glycol dimethacrylate and 1,3-butanediol dimethacrylate; divinyl compounds as exemplified by divinyl aniline, divinyl ether, divinyl sulfide and divinyl sulfone; and compounds having at least three vinyl groups; any of which may be used alone or in the form of a mixture.

In the toner of the present invention, a charge control agent may preferably be used by compounding it into toner particles (internal addition) or blending it with toner particles (external addition). The charge control agent enables control of optimum electrostatic charges in conformity with developing systems. Particularly in the present invention, it can make the balance between particle size distribution and charging more stable. A positive charge control agent may include Nigrosine and products modified with a fatty acid metal salt; quaternary ammonium salts such as tributylbenzylammonium 1-hydroxy-4-naphthoslulfonate and tetrabutylammonium teterafluoroborate, and analogues of these, including onium salts such as phosphonium salts and lake pigments of these, triphenyl methane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; any of which may be used alone or in combination of two or more kinds. Of these, charge control agents such as Nigrosine types, quaternary ammonium salts and triphenylymethane pigments may particularly preferably be used.

Homopolymers of monomers represented by the following Formula;

Formula

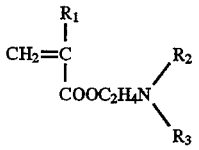

$R_1$: H or $CH_3$ $R_2$, $R_3$: substituted or unsubstituted alkyl group, preferably $C_1$ to $C_4$;

or copolymers of polymerizable monomers such as styrene, acrylates or methacrylates as described above may also be used as positive charge control agents. In this case, these charge control agents can also act as binder resins (as a whole or in part).

An agent capable of controlling toner to have negative chargeability may include the following substances.

For example, organic metal complex salts and chelate compounds are effective, which include monoazo metal complexes, acetylyacetone metal complexes and aromatic hydroxycarboxylic acids or aromatic dicarboxylic acid type metal complexes. Besides, they include aromatic hydroxycarboxylic acids, aromatic mono- or polycarboxylic acids and metal salts, anhydrides or esters thereof, and phenol derivatives such as bisphenol.

The charge control agents described above (those having no action as binder resins) may preferably be used in the form of fine particles. In this case, the charge control agent may preferably have a number average particle diameter of specifically 4 μm or less, and more preferably 3 μm or less.

When internally added to the toner, such a charge control agent may preferably be used in an amount of from 0.1 part to 20 parts by weight, and more preferably from 0.2 part to 10 parts by weight, based on 100 parts by weight of the binder resin.

Fine silica powder may preferably be added to the toner of the present invention in order to improve charge stability, developability, fluidity end running performance.

As the fine silica powder used in the present invention, e fine silica powder having a surface specific area, as measured by the BET method using nitrogen absorption, of not less than 30 $m^2/g$, end preferably in the range of from 50 to 400 $m^2/g$, can give good results. The fine silica powder should preferably be used in an amount of from 0.01 part to 8 parts by weight, and more preferably from 0.1 part to 5 parts by weight, based on 100 parts by weight of the toner.

The fine silica powder used in the present invention may preferably be optionally treated, for the purpose of making it hydrophobic or controlling its chargeability, with a treating agent such as silicone varnish, every sort of modified silicone varnish, silicone oil, every sort of modified silicone oil, a silane coupling agent, a silane coupling agent having a functional group, or other organic silicon compound, or with various treating agents used in combination.

As other additives to the toner, a lubricant powder as exemplified by Teflon powder, zinc stearate powder or polyvinylidene fluoride powder, in particular, polyvinylidene fluoride powder, is preferred. An abrasive such as cerium oxide powder, silicon carbide powder or strontium titanate powder, in particular, strontium titanate powder, is also preferred. A fluidity-providing agent as exemplified by titanium oxide powder or aluminum oxide powder, in particular, hydrophobic one, is still also preferred. An anti-caking agent or a conductivity-providing agent as exemplified by carbon black powder, zinc oxide powder, antimony oxide powder or tin oxide powder, as well as a developability improver such as white fine particles or black fine particles with a reverse polarity, may also be used in small amounts.

The toner of the present invention, when used as a two-component developer, is mixed with a carrier powder. In this case, the toner and the carrier powder should preferably be mixed in such a proportion that the toner is in concentration of 0.1 to 50% by weight, more preferably from 0.5 to 10% by weight, and still more preferably from 3 to 10% by weight.

As the carrier usable in the present invention, any known carriers can be used, including, for example, magnetic powders such as iron powder, ferrite powder and nickel, glass beads, and these powders or glass beads whose surfaces have been treated with a fluorine resin, a vinyl resin or a silicone resin.

The toner of the present invention may also include a magnetic material so that it can be used as a one-component developer making use of a magnetic toner. In this case, the magnetic material may also serve as a colorant. In the present invention, the magnetic material contained in the magnetic toner may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These ferromagnetic materials may be those having an average particle diameter of 2 μm or less, and preferably from 0.1 to 5 μm, in approximation. Any of these materials should be contained in the toner preferably in an amount of from about 20 to about 200 parts by weight, and particularly preferably from 40 to 150 parts by weight, based on 100 parts by weight of the resin component.

The magnetic material may also preferably those having a coercive force (Hc) of from 20 to 300 oersted, a saturation magnetization ($\sigma s$) of from 50 to 200 emu/g and a residual magnetization ($\sigma r$) of from 2 to 20 emu/g, as magnetic characteristics under application of 10K oersted.

The colorant usable in the present invention may include any suitable pigments or dyes. The colorant for the toner can be exemplified by pigments including carbon black, aniline black, acetylene black, Naphthol Yellow, Hanza Yellow, Rhodamine Lake, Alizarine Lake, red iron oxide, Phthalocyanine Blue and Indanthrene Blue. Any of these may be used in an amount necessary end enough to maintain the optical density of fixed images, preferably from 0.1 to 20 parts by weight, end more preferably from 0.2 to 10 parts by weight, based on 100 parts by weight of the resin.

For the same purpose, a dye may also be used. For example, it may include azo dyes, anthraquinone dyes, xanthene dyes and methine dyes, and should preferably be added in an amount of from 0.1 to 20 parts by weight, and more preferably from 0.3 to 10 parts by weight, based on 100 parts by weight of the resin.

The toner for developing an electrostatic image according to the present invention can be produced in the following way: The binder resin and the wax, as well as the metal salt or metal complex, the pigment or dye as the colorant, the magnetic material, end optionally the charge control agent and other additives, which are other toner components, are thoroughly mixed using a mixing machine such as a Henschel mixer or a ball mill, and then the mixture is melt-kneaded using a heat kneading machine such as a heating roll, a kneader or an extruder to make the resin and so on melt one another, in which a metal compound, a pigment, a dye and a magnetic material are then dispersed or dissolved, followed by cooling for solidification and thereafter pulverization and classification. Thus the toner according to the present invention can be obtained.

If necessary, any desired additives may be further thoroughly mixed using a mixing machine such as a Henschel mixer. Thus, the toner for developing an electrostatic image according to the present invention can be obtained.

An example of the image forming method of the present invention, having a contact charging means and a contact transfer means will be described with reference to FIG. 1, a schematic illustration of its constitution.

Reference numeral 1 denotes a rotating drum type electrostatic latent image bearing member (hereinafter "photosensitive member)". The photosensitive member 1 basically comprises a conductive substrate layer 1*b* made of aluminum or the like and a photoconductive layer 1*a* formed on its periphery, and is clockwise rotated as viewed in the drawing, at a given peripheral speed.

Reference numeral 2 denotes a charging roller serving as the contact charging means, which is basically comprised of a mandrel 2*b* at the center and a conductive elastic layer 2*a* formed on its periphery. The charging roller 2 is pressed to the surface of the photosensitive member 1 at a given pressure, and is rotated followingly as the photosensitive member 1 is rotated. Reference numeral 3 denotes a charging bias power source through which a voltage is applied to the charging roller 2. Application of a bias to the charging roller 2 charges the surface of the photosensitive member 1 to a given polarity and potential. Imagewise exposure 4 is subsequently carried out to form electrostatic latent images, which are developed by a developing means 5 holding the toner and successively converted into visible images as toner images.

Reference numeral 6 denotes a transfer roller serving as the contact transfer member, which is basically comprised of a mandrel 6*b* at the center and a conductive elastic layer 6*a* formed on its periphery. The transfer roller 6 is brought into pressure contact with the surface of the photosensitive member 1 at a given pressure, interposing a recording medium between them at least at the time of transfer, and is rotated at a speed equal to the peripheral speed, or at a speed different from the peripheral speed, of the photosensitive member 1. A recording medium 8 is transported between the photosensitive member 1 and the transfer roller 6 and at the same time a bias with a polarity reverse to that of the triboelectricity of the toner is applied to the transfer roller 6 from a transfer bias power source 7, so that the toner image on the photosensitive member 1 is transferred to the surface of the transfer medium 8.

Subsequently, the recording medium 8 is transported to a fixing assembly 11 basically comprised of a heating roller 11*a* internally provided with a halogen heater and an elastic-material pressure roller 11*b* brought into pressure contact with it at a given pressure, end is passed between the rollers 11*a* and 11*b*, so that the toner image is fixed. From the surface of the photosensitive member 1 from which the toner image has been transferred, contaminants such as untransferred toner remaining adhered thereto are removed by means of a cleaning assembly 9 provided with an elastic cleaning blade counter-clockwise brought into pressure contact with the photosensitive member 1. The surface is then erased through a pre-exposure assembly 10, and is repeatedly used for image formation. A method of fixing may also be used where the toner image is fixed by means of a heater with a film between.

The image forming apparatus having such contact charging means and contact transfer means enables uniform charging of the photosensitive member and satisfactory transfer therefrom under application of a bias with a relatively low voltage compared with corona charging or corona transfer. Hence, such an apparatus has advantages that the charger can be small-sized and the generation of corona discharge by-products such as ozone can be prevented.

As the other contact charging means, there are methods in which a charging blade or a conductive brush is used. These contact charging means can make the application of high voltage unnecessary and can reduce the generation of ozone, but there occurs the problem of melt-adhesion of toner because the member comes into direct contact with the photosensitive member. However, use of the toner of the present invention can solve such problems.

The present invention by no means limits the manner and the effect of the contact charging means. The present invention can be applied to all methods so long as the charging member is brought into direct contact with a photosensitive member to effect charging.

As the preferable process conditions when the charging roller is used, the roller may be in contact at a pressure of from 5 to 500 g/cm, and the bias is, when a direct voltage superimposed with an alternating voltage is used, an alternating voltage of from 0.5 to 5 kVpp, an alternating frequency of from 50 to 5 kHz and a direct voltage of from ±0.2 to ±1.5 kV, and when a direct voltage is used, a direct voltage of from ±0.2 to ±5 kV.

The charging roller and the charging blade may preferably be made of conductive rubber, and may each be provided on their surfaces with a release film. As the release film, it is possible to use nylon resins, PVDF (polyvinylidene fluoride), PVDC (polyvinylidene chloride), etc.

The transfer roller usable in the present invention may be made of the same material as that of the charging roller. As preferable process conditions for the transfer, the roller may be in contact at a pressure of from 5 to 500 g/cm, and may be biased with a direct voltage of from from ±0.2 to ±10 kV.

As described above, the toner of the present invention employs the wax having Mw/Mn of not more than 1.5. Hence it can improve fixing performance and anti-offset properties without spoiling blocking resistance, and can provide an image forming method that may cause no melt-adhesion and promises a superior running performance. The toner can also have a superior transfer performance and a good utilization rate, so that images with a high image density and free from fog can be obtained at a low toner consumption.

EXAMPLES

The present invention will be specifically described below by giving Examples. The present invention is by not means limited to these. In the following, "part(s)" refers to "part(s) by weight" unless particularly noted.

Molecular weight of the wax used in the present invention is shown in Table 1, end the properties in Table 2.

The wax denoted in the tables by ". . . –1" is an original wax, and the waxes denoted by ". . . –2" and ". . . –3" are those obtained after fractionation. "C" indicates a low-molecular weight polyethylene which is a by-product formed when polyethylene is polymerized using ethylene as a main component in the presence of Ziegler catalyst. A-2, A-3, B-2, C-3, D-2, F-2 and G-2 are the waxes fractionated by supercritical fluid extraction, B-3, C-2, E-2 are the wax obtained by vacuum distillation and following melt-crystallization-filtration, and B-4 is the one fractionated by recrystallization.

Preparation of waxes A-2, A-3, B-2, C-3, D-2, F-2 and G-2

They are prepared by supercritical fluid extraction. Wax A-1 is put in a pressure-proof extraction vessel and extracted into $CO_2$ at 130° C., under 300 atm, then the extract is transferred to a pressure-proof separation vessel with reduction of the pressure to 200 atm to separate a wax of high melting point. A-2 wax having physical properties shown in Table 1 was thus obtained. The starting wax, precipitation pressure, end the number of fractionation were changed to obtain wax A-3, B-2, C-3, D-2, F-2 and G-2 respectively. Their physical properties are shown in Tables 1 and 2.

Preparation of wax B-3, C-2 and F-2

Using wax B-1 as the starting material, the first distillation was carried out at 3 mmHg and 180°–300° C., the second distillation at 0.2 mmHg and 250° C., the third distillation at 0.02 mmHg and 280° C., the fourth distillation at 0.01 mmHg and 280° C. Subsequently, the distillates were subjected to melt-crystallization-filtration to obtain wax B-3 of which physical properties are shown in Tables 1 and 2. Further, changing the starting wax, distillation pressure, distillation temperature and the number of distillation properly, wax C-2 and wax E-2 were obtained.

Preparation of wax B-4

Wax B-4 was obtained from wax B-1 by recrystallization using a melt. The physical properties of wax B-4 are shown in Tables 1 and 2.

TABLE 1

| | Molecular Weight of Wax | | | |
|---|---|---|---|---|
| Wax | Number average molecular weight (Mn) | Weight average molecular weight (Mw) | Mw/Mn | Type of wax |
| A-1 | 537 | 907 | 1.69 | Synthetic HC |
| A-2 | 796 | 1,090 | 1.37 | Synthetic HC |
| A-3 | 952 | 1,380 | 1.45 | Synthetic HC |
| B-1 | 551 | 1,714 | 3.11 | Polyolefin |
| B-2 | 1,370 | 2,014 | 1.47 | Polyolefin |
| B-3 | 695 | 959 | 1.38 | Polyolefin |
| B-4 | 816 | 1,412 | 1.73 | Polyolefin |
| C-2 | 583 | 688 | 1.18 | By-product* |
| C-3 | 992 | 1,260 | 1.27 | By-product* |
| D-1 | 440 | 866 | 1.97 | Alcohol |
| D-2 | 797 | 996 | 1.25 | Alcohol |
| E-1 | 591 | 1,074 | 1.82 | Montan |
| E-2 | 794 | 1,120 | 1.41 | Montan |
| F-2 | 860 | 1,024 | 1.19 | Alcohol/ethylene oxide adduct |
| G-2 | 715 | 973 | 1.36 | Carboxylic acid |

HC: hydrocarbon;
*of the polymerization

TABLE 2

| | Properties of Wax | | | |
|---|---|---|---|---|
| Wax | Onset temp. (°C.) | Temp. difference to end point onset temp. | Peak top temp. (°C.) | Type of wax |
| A-1 | 63 | 48 | 80 | Synthetic HC |
| A-2 | 91 | 24 | 105 | Synthetic HC |
| A-3 | 95 | 21 | 114 | Synthetic HC |
| B-1 | 40 | 87 | 102 | Polyolefin |
| B-2 | 85 | 35 | 116 | Polyolefin |
| B-3 | 72 | 40 | 102 | Polyolefin |
| B-4 | 61 | 66 | 106 | Polyolefin |
| C-2 | 67 | 34 | 91 | By-product* |
| C-3 | 101 | 16 | 111 | By-product* |
| D-1 | 63 | 44 | 98 | Alcohol |
| D-2 | 75 | 31 | 100 | Alcohol |
| E-1 | 35 | 53 | 81 | Montan |
| E-2 | 68 | 20 | 88 | Montan |
| F-2 | 84 | 28 | 108 | Alcohol/ethylene oxide adduct |
| G-2 | 100 | 12 | 109 | Carboxylic acid |

HC: hydrocarbon;
*of the polymerization

Example 1

| | |
|---|---|
| Styrene-butyl acrylate copolymer | 100 parts |
| Magnetic iron oxide | 80 parts |
| Nigrosine | 2 parts |
| Wax A-2 | 4 parts |

The above materials were premixed, and then melt-kneaded using a twin-screw kneading extruder set to 130° C. The kneaded product was cooled, and then crushed. Thereafter the crushed product was finely pulverized by means of a grinding mill making use of a jet stream, followed by classification using an air classifier to give toner particles with a weight average particle diameter of 8 μm.

Based on 100 parts of the above toner particles, 0.6 part of positively chargeable hydrophobic colloidal silica was externally added to give a toner, and this toner was used as a one-component developer.

Various performances were evaluated using a commercially available electrophotographic copying machine NP-6030 (manufacture by Canon Inc.; employing a contact charging means and a contact transfer means). Results obtained are shown in Table 3.

Fixing performance test

A fast-copy test was carried out to evaluate fixing performance. To evaluate the fixing performance, an image was rubbed 10 times using Silbon paper under a load of about 100 g to examine any separation of the image, which was evaluated as the rate of decrease in reflection density.

Offset test

Copies were continuously taken on 200 sheets of B5-size recording paper, and immediately thereafter copies were taken using A3-size paper. Any high-temperature offset due to temperature rise at end portions of the drum was examined to evaluate it on whether or not image stain occurred.

Running performance test

A running test was made on 10,000 sheets of A4-size paper fed lengthwise to evaluate image density (Dmax), fog, melt-adhesion and utilization rate. Here, the utilization rate refers to the proportion of the toner transferred to an image, to the toner consumed, and is determined from the following expression. When a numerical value obtained is large, it means that the toner has been effectively used, a waste toner is small and copies with a high image density can be obtained at a small toner consumption.

{(quantity of toner consumed—quantity of waste toner in cleaner)/(quantity of toner consumed)}×100

Blocking test

About 20 g of a toner was put in a 100 ml polyethylene cup, which was then left to stand at 50° C. for 3 days, and thereafter visual evaluation was made.

Excellent (AA): No agglomerates are seen.

Good (A): Agglomerates are seen but readily disintegrable.

Passable (B): Agglomerates are seen but readily disintegrable when shaked.

Failure (C): Agglomerates can be grasped and are not disintegrable with ease.

Example 2

| | |
|---|---|
| Styrene/butyl acrylate copolymer | 100 parts |
| Magnetic iron oxide | 80 parts |
| Nigrosine | 2 parts |
| Wax A-3 | 4 parts |

Using the above materials, a one-component developer was prepared in the same manner as in Example 1. Evaluation was similarly made. Results obtained are shown in Table 3.

Comparative Example 6

| | |
|---|---|
| Styrene/butyl acrylate copolymer | 100 parts |
| Magnetic iron oxide | 80 parts |
| Nigrosine | 2 parts |
| Wax B-2 | 4 parts |

Using the above materials, a one-component developer was prepared in the same manner as in Example 1. Evaluation was similarly made. Results obtained are shown in Table 3.

Example 4

| | |
|---|---|
| Styrene/butyl acrylate copolymer | 100 parts |
| Magnetic iron oxide | 80 parts |
| Nigrosine | 2 parts |
| Wax B-3 | 4 parts |

Using the above materials, a one-component developer was prepared in the same manner as in Example 1. Evaluation was similarly made. Results obtained are shown in Table 3.

Example 5

| | |
|---|---|
| Styrene/butyl acrylate copolymer | 100 parts |
| Magnetic iron oxide | 80 parts |
| Nigrosine | 2 parts |
| Wax C-2 | 4 parts |

Using the above materials, a one-component developer was prepared in the same manner as in Example 1. Evaluation was similarly made. Results obtained are shown in Table 3.

Example 6

| | |
|---|---|
| Styrene/butyl acrylate copolymer | 100 parts |
| Magnetic iron oxide | 80 parts |
| Nigrosine | 2 parts |
| Wax C-3 | 4 parts |

Using the above materials, a one-component developer was prepared in the same manner as in Example 1. Evaluation was similarly made. Results obtained are shown in Table 3.

Example 7

| | |
|---|---|
| Styrene/butyl acrylate copolymer | 100 parts |
| Magnetic iron oxide | 80 parts |
| Nigrosine | 2 parts |
| Wax D-2 | 4 parts |

Using the above materials, a one-component developer was prepared in the same manner as in Example 1. Evaluation was similarly made. Results obtained are shown in Table 3.

Example 8

| | |
|---|---|
| Styrene/butyl acrylate copolymer | 100 parts |
| Magnetic iron oxide | 80 parts |
| Nigrosine | 2 parts |
| Wax E-2 | 4 parts |

Using the above materials, a one-component developer was prepared in the same manner as in Example 1. Evaluation was similarly made. Results obtained are shown in Table 3.

Example 9

| | |
|---|---|
| Styrene/butyl acrylate copolymer | 100 parts |
| Magnetic iron oxide | 80 parts |
| Nigrosine | 2 parts |
| Wax F-2 | 4 parts |

Using the above materials, a one-component developer was prepared in the same manner as in Example 1. Evaluation was similarly made. Results obtained are shown in Table 3.

Example 10

| | |
|---|---|
| Styrene/butyl acrylate copolymer | 100 parts |
| Magnetic iron oxide | 80 parts |
| Nigrosine | 2 parts |
| Wax G-2 | 4 parts |

Using the above materials, a one-component developer was prepared in the same manner as in Example 1. Evaluation was similarly made. Results obtained are shown in Table 3.

Comparative Example 1

| | |
|---|---|
| Styrene/butyl acrylate copolymer | 100 parts |
| Magnetic iron oxide | 80 parts |
| Nigrosine | 2 parts |
| Wax A-1 | 4 parts |

Using the above materials, a one-component developer was prepared in the same manner as in Example 1. Evaluation was similarly made. Results obtained are shown in Table 3.

Comparative Example 2

| | |
|---|---|
| Styrene/butyl acrylate copolymer | 100 parts |
| Magnetic iron oxide | 80 parts |
| Nigrosine | 2 parts |
| Wax B-1 | 4 parts |

Using the above materials, a one-component developer was prepared in the same manner as in Example 1. Evaluation was similarly made. Results obtained are shown in Table 3.

Comparative Example 3

| | |
|---|---|
| Styrene/butyl acrylate copolymer | 100 parts |
| Magnetic iron oxide | 80 parts |
| Nigrosine | 2 parts |
| Wax D-1 | 4 parts |

Using the above materials, a one-component developer was prepared in the same manner as in Example 1. Evaluation was similarly made. Results obtained are shown in Table 3.

Comparative Example 4

| | |
|---|---|
| Styrene/butyl acrylate copolymer | 100 parts |
| Magnetic iron oxide | 80 parts |
| Nigrosine | 2 parts |
| Wax E-1 | 4 parts |

Using the above materials, a one-component developer was prepared in the same manner as in Example 1. Evaluation was similarly made. Results obtained are shown in Table 3.

Comparative Example 5

| | |
|---|---|
| Styrene/butyl acrylate copolymer | 100 parts |
| Magnetic iron oxide | 80 parts |
| Nigrosine | 2 parts |
| Wax B-4 | 4 parts |

Using the above materials, a one-component developer was prepared in the same manner as in Example 1. Evaluation was similarly made. Results obtained are shown in Table 3.

TABLE 3

| | Image evaluation | | | | | | | |
|---|---|---|---|---|---|---|---|---|
| | Running performance | | | | | Fixing | | |
| | Dmax | | | Melt | Uti- | per- | Image | |
| | Start | 10,000 sheets | Fog | adhe-sion | liza-tion | form-ance | off-set | (1) |
| Example: | | | | | | | | |
| 1 | 1.42 | 1.42 | AA | None | 88% | 4% | None | AA |
| 2 | 1.42 | 1.41 | AA | None | 88% | 5% | None | AA |
| Comparative Example 6 | 1.38 | 1.39 | AA | None | 87% | 12% | None | AA |
| 4 | 1.38 | 1.38 | A | None | 87% | 8% | None | AA |
| 5 | 1.36 | 1.35 | AA | None | 86% | 6% | None | A |
| 6 | 1.38 | 1.40 | AA | None | 87% | 7% | None | AA |
| 7 | 1.34 | 1.33 | AA | None | 86% | 9% | None | AA |
| 8 | 1.33 | 1.33 | A | None | 86% | 8% | None | A |
| 9 | 1.35 | 1.37 | AA | None | 87% | 7% | None | AA |
| 10 | 1.34 | 1.35 | AA | None | 86% | 6% | None | AA |
| Comparative Example: | | | | | | | | |
| 1 | 1.37 | 1.38 | A | * | 85% | 5% | None | A |
| 2 | 1.35 | 1.30 | A | * | 84% | 8% | None | B |
| 3 | 1.30 | 1.26 | B | ** | 82% | 8% | None | B |
| 4 | 1.30 | 1.23 | B | ** | 81% | 7% | ** | C |
| 5 | 1.37 | 1.38 | B | None | 85% | 10% | None | A |

(1) Blocking resistance;
*Slightly occur;
**Occur

Example 11

Using the same one-component developer as used in Example 1, various performances were evaluated using a commercially available electrophotographic copying machine NP-4080 (manufacture by Canon Inc.; employing a corona charging means and a corona transfer means). Results obtained are shown in Table 4.

Fixing performance test

A fast-copy test was carried out to evaluate fixing performance. To evaluate the fixing performance, an image was rubbed 10 times using Silbon paper under a load of about 100 g to examine any separation of the image, which was evaluated as the rate of decrease in reflection density.

Offset test

Copies were continuously taken on 200 sheets of B5-size recording paper, and immediately thereafter copies were taken using A3-size paper. Any high-temperature offset due to temperature rise at end portions of the drum was examined to evaluate it on whether or not image stain occurred.

Running performance test

A 10,000 sheet running test was made to evaluate image density (Dmax), fog, melt-adhesion and utilization rate.

Blocking test

Made in the same manner as in Example 1.

Examples 12 and 14–20 and Comparative Example 7

Using the same one-component developers as used in Examples 2 to 10, evaluation was made in the same manner as in Example 11. Results obtained are shown in Table 4.

TABLE 4

| | Image evaluation | | | | | | | |
|---|---|---|---|---|---|---|---|---|
| | Running performance | | | | | Fixing | | |
| | Dmax | | | Melt | Uti- | per- | Image | |
| | Start | 10,000 sheets | Fog | adhe-sion | liza-tion | form-ance | off-set | (1) |
| Example: | | | | | | | | |
| 11 | 1.40 | 1.40 | AA | None | 86% | 3% | None | AA |
| 12 | 1.39 | 1.40 | AA | None | 86% | 4% | None | AA |
| Comparative Example 7 | 1.36 | 1.36 | AA | None | 85% | 11% | None | AA |
| 14 | 1.35 | 1.36 | AA | None | 85% | 6% | None | AA |
| 15 | 1.34 | 1.33 | AA | None | 86% | 5% | None | A |
| 16 | 1.35 | 1.36 | AA | None | 87% | 6% | None | AA |
| 17 | 1.33 | 1.32 | AA | None | 85% | 7% | None | AA |
| 18 | 1.32 | 1.31 | AA | None | 85% | 6% | None | A |
| 19 | 1.34 | 1.36 | AA | None | 85% | 8% | None | AA |
| 20 | 1.35 | 1.35 | AA | None | 85% | 7% | None | AA |

(1) Blocking resistance

What is claimed is:

1. A heat-fixable toner for developing an electrostatic image comprising a binder resin and a wax, wherein said wax is a member selected from the group consisting of (i) a synthetic hydrocarbon synthesized from a synthetic gas comprised of carbon monoxide and hydrogen, and (ii) a synthetic hydrocarbon obtained by hydrogenation thereof; said wax having a number average molecular weight (Mn) from 300 to 1,500 and a molecular weight distribution value of weight average molecular weight/number average molecular weight (Mw/Mn) of not more than 1.45 as measured by gel permeation chromatography.

2. The toner according to claim 1, wherein said wax has a number average molecular weight (Mn) of from 300 to 1,500 and a weight average molecular weight (Mw) of from 500 to 2,250.

3. The toner according to claim 1, wherein said wax has a number average molecular weight (Mn) of from 400 to 1,200 and a weight average molecular weight (Mw) of from 600 to 2,000.

4. The toner according to claim 1, wherein said wax has a number average molecular weight (Mn) of from 600 to 1,000 and a weight average molecular weight (Mw) of from 800 to 1,800.

5. The toner according to claim 1, wherein said wax is a wax obtained by subjecting a wax having a value of weight average molecular weight/number average molecular weight (Mw/Mn) of more than 1.45, to fractionation to have a value of weight average molecular weight/number average molecular weight (Mw/Mn) of not more than 1.45.

6. The toner accordingly to claim 5, wherein said fractionation is carried out by supercritical fluid extraction.

7. The toner according to claim 5, wherein said fractionation is carried out by vacuum distillation and subjecting a distillate resulting therefrom to melt crystallization followed by filtration of crystals.

8. The toner according to claim 1, wherein in the DSC curve of said wax measured using a differential scanning calorimeter, an onset temperature is 50° C. or above in relation to an endothermic peak at the time of temperature rise.

9. The toner according to claim 1, wherein in the DSC curve of said wax measured using a differential scanning calorimeter, an onset temperature is from 50° C. to 120° C. in relation to an endothermic peak at the time of temperature rise.

10. The toner according to claim 1, wherein in the DSC curve of said wax measured using a differential scanning calorimeter, a peak top temperature is 130° C. or below in relation to a maximum endothermic peak at the time of temperature rise.

11. The toner according to claim 1, wherein in the DSC curve of said wax measured using a differential scanning calorimeter, a peak top temperature is from 70° C. to 130° C. in relation to a maximum endothermic peak at the time of temperature rise.

12. The toner according to claim 1, wherein in the DSC curve of said wax measured using a differential scanning calorimeter, an end-point onset temperature of the endothermic peak is 80° C. or above.

13. The toner according to claim 1, wherein in the DSC curve of said wax measured using a differential scanning calorimeter, an end-point onset temperature of the endothermic peak is from 80° C. to 140° C.

14. The toner according to claim 1, wherein said wax comprises a Fischer-Tropsch wax.

15. The toner according to claim 1, wherein said toner contains said wax in an amount of not more than 20 parts by weight based on 100 parts by weight of the binder resin.

16. The toner according to claim 1, wherein said toner contains said wax in an amount of from 0.5 part by weight to 10 parts by weight based on 100 parts by weight of the binder resin.

17. The toner according to claim 1, wherein said toner comprises a magnetic toner containing a magnetic material.

18. The toner according to claim 1, wherein said toner comprises a non-magnetic color toner containing a colorant.

* * * * *

UNITED STATES PATENT AND TRADEMARK OFFICE

CERTIFICATE OF CORRECTION

PATENT NO. : 5,629,122

DATED : May 13, 1997

INVENTOR(S) : HIROHIDE TANIKAWA ET AL.

It is certified that error appears in the above-identified patent and that said Letters Patent is hereby corrected as shown below:

COLUMN 1

Line 26, "end" should read --and--.
Line 29, "wake," should read --make--.
Line 32, "down sizing" should read --downsizing--.
Line 34, "higher-speed" should read --higher speed--.
Line 45, "No. 62-14166." should read --No. 62-14166,--.

COLUMN 2

Line 43, "comprising;" should read --comprising:--.
Line 46, "staticaly" should read --statically--.

COLUMN 3

Line 4, "They" should read --They,-- and "hand" should read --hand,--.
Line 38, "melt adhesion" should read --melt-adhesion--.

COLUMN 4

Line 20, "end" should read --and--.
Line 40, "transfered" should read --transferred--.
Line 41, "poiont" should read --point--.

UNITED STATES PATENT AND TRADEMARK OFFICE

CERTIFICATE OF CORRECTION

PATENT NO. : 5,629,122

DATED : May 13, 1997

INVENTOR(S) : HIROHIDE TANIKAWA ET AL.

It is certified that error appears in the above-identified patent and that said Letters Patent is hereby corrected as shown below:

COLUMN 5

Line 2, "fluid, for" should read --fluid. For--.
Line 30, "260°-290° C." should read --260°-290° C.,--.
Line 53, "collect" should read --collecting--.
Line 66, "not" should read --are not--.

COLUMN 6

Line 12, "end" should read --and--.
Line 15, "end" should read --and--.

COLUMN 7

Line 37, "synthesis" should read --synthetic--.

COLUMN 9

Line 51, "end" should read --and--.
Line 52, "e" should read --a--.
Line 55, "end" should read --and--.

UNITED STATES PATENT AND TRADEMARK OFFICE

CERTIFICATE OF CORRECTION

PATENT NO. : 5,629,122

DATED : May 13, 1997

INVENTOR(S) : HIROHIDE TANIKAWA ET AL.

It is certified that error appears in the above-identified patent and that said Letters Patent is hereby corrected as shown below:

COLUMN 10

Line 8, "hydrophobic" should read --a hydrophobic--.
Line 19, "concentration" should read --a concentration--.
Line 25, "these" should read --those--.
Line 47, "preferably" should read --preferably be--.
Line 55, "Hanza" should read --Hansa--.
Line 58, "end" should read --and--.
Line 60, "end" should read --and--.

COLUMN 11

Line 5, "end" should read --and--.
Line 66, "end" should read --and--.

COLUMN 12

Line 65, "not" should read --no--.

COLUMN 13

Line 2, "end" should read --and--.
Line 8, "Ziegler" should read --a Ziegler--.
Line 10, "wax" should read --waxes--.
Line 23, "end" should read --and--.

UNITED STATES PATENT AND TRADEMARK OFFICE

CERTIFICATE OF CORRECTION

PATENT NO. : 5,629,122

DATED : May 13, 1997

INVENTOR(S) : HIROHIDE TANIKAWA ET AL.

It is certified that error appears in the above-identified patent and that said Letters Patent is hereby corrected as shown below:

COLUMN 19

Line 30, "Examples 2 to 10," should read --Examples 2 and 4-10 and Comparative Example 6--.

Signed and Sealed this

Twenty-fifth Day of November, 1997

*Attest:*

Bruce Lehman

BRUCE LEHMAN

*Attesting Officer*

*Commissioner of Patents and Trademarks*